United States Patent [19]

Harel

[11] Patent Number: 4,945,289

[45] Date of Patent: Jul. 31, 1990

[54] ELECTRONIC SUPPLY SYSTEM FOR FLUORESCENT TUBES WITH ELECTRODES

[75] Inventor: Jean-Claude Harel, Tarascon, France

[73] Assignee: Interpatents Ltd., London, England

[21] Appl. No.: 162,407

[22] PCT Filed: May 20, 1987

[86] PCT No.: PCT/CH87/00055

§ 371 Date: Jan. 25, 1988

§ 102(e) Date: Jan. 25, 1988

[87] PCT Pub. No.: WO87/07469

PCT Pub. Date: Dec. 3, 1987

[30] Foreign Application Priority Data

May 23, 1986 [FR] France ..... 86 07508

[51] Int. Cl.[5] ..... H05B 41/29

[52] U.S. Cl. ..... 315/226; 315/219; 315/DIG. 7

[58] Field of Search ..... 315/224, 287, DIG. 7, 315/245, 205, 219, 226

[56] References Cited

U.S. PATENT DOCUMENTS

| | | | |
|---|---|---|---|
| 3,890,537 | 6/1975 | Park et al. | 315/208 |
| 4,398,128 | 8/1983 | Wallank | 315/244 |
| 4,481,460 | 11/1984 | Kroning et al. | 315/DIG. 7 |
| 4,527,098 | 7/1985 | Owen | 315/290 |
| 4,562,383 | 12/1985 | Kerscher et al. | 315/307 |

FOREIGN PATENT DOCUMENTS

| | | |
|---|---|---|
| 0126556 | 11/1984 | European Pat. Off. . |
| 0171108 | 2/1986 | European Pat. Off. . |
| 3235381 | 3/1984 | Fed. Rep. of Germany . |
| 3412944 | 10/1985 | Fed. Rep. of Germany . |
| 2478933 | 9/1981 | France . |
| 2520575 | 7/1983 | France . |
| 2080652 | 2/1982 | United Kingdom . |
| 8700719 | 1/1987 | World Int. Prop. O. . |

*Primary Examiner*—Eugene R. Laroche

*Attorney, Agent, or Firm*—Sandler, Greenblum & Bernstein

[57] ABSTRACT

An electronic supply system for fluorescent tubes with electrodes includes two MOS power transistors connected in series and, connected to a common point between those transistors, a series circuit including a primary winding of a transformer, of which two secondary windings control the transistors, a lighting unit or units and a capacitor 10. The capacitor is connected to a supply means output terminal opposite a secondary supply means output terminal where one of the transistors, which transistor is driven by a diac, is connected.

5 Claims, 1 Drawing Sheet

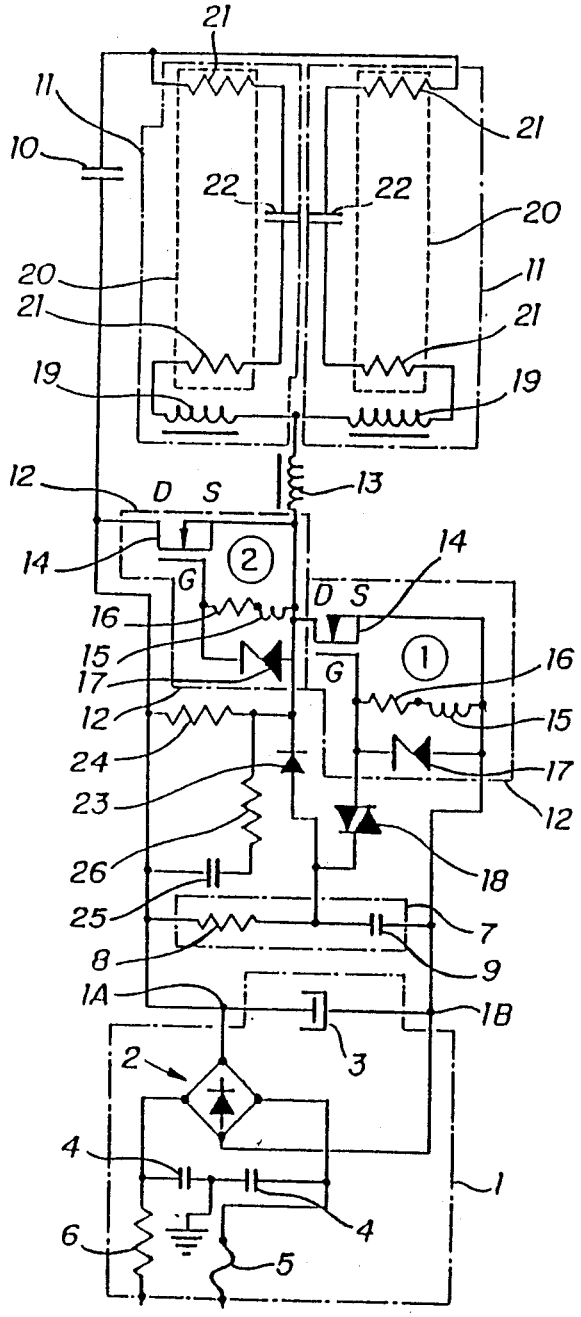
21
11
10
22
22
20
20
11
21
21
19
19
12
D S
13
14
2
G
14
D S
16
15
17
G
1
16
12
15
24
17
23
12
26
18
25
7
8
9
1A
1B
3
2
4
1
4
6
5

ELECTRONIC SUPPLY SYSTEM FOR FLUORESCENT TUBES WITH ELECTRODES

BACKGROUND OF THE INVENTION

1. Field of the Invention

The present invention relates to electronic supply systems for fluorescent tubes with electrodes and, more particularly, to electronic supply systems for fluorescent tubes with electrodes that allow virtual instantaneous ignition and energy savings.

2. Description of the Prior Art

The majority of fluorescent tubes currently in use are supplied by a system which has several shortcomings. Two major shortcomings are high energy consumption and rapid tube deterioration. These prior art assemblies comprise a reactance and use the opening of a bimetallic strip to energize a gaseous mixture located between filaments in the tube. Because ignition is rarely instantaneous, several openings of the bimetallic strip are generally required. These repeated openings cause the tube to flicker, which is detrimental to its service life. Further, the reactance consumes a large amount of energy which causes it to heat. Still further, the reactance introduces a large amount of reactivity into the mains line, which increases consumption proportionately.

Research has been carried out with a view towards producing a supply system using only semi-conductor components and transformers so as to consume very little energy and so as to allow instantaneous ignition.

One design, among others, is illustrated in French Specification No. 2,520,575. This design uses two series-mounted transistors which amplify a square signal supplied by an auxiliary frequency generating circuit and transmit it to a series oscillating circuit comprising a coil L1, a lighting unit and a charge capacitor C3.

This system was rapidly improved by omitting the related frequency-generating circuit and by replacing it with a transformer which receives a sinusoidal signal from the oscillating series circuit and uses it to control the two transistors. This system, which is simple in design and is illustrated in French Specification FR No. 2,478,933, has two disadvantages. First, its start-up is random and second, short periods during which the transistors simultaneous allow passage of current are possible. During such periods, the lighting unit is extinguished as it no longer receives a supply and the transistors are traversed by high intensity current which is harmful to their service life.

Various patents providing solutions to the above-mentioned problems have been filed. Three of them, specifications EP No. 0171108, DE No. 3,412,944 and WO No. 87/00719, are discussed in some detail below.

Certain start-up of a circuit is attained, for example, by transmitting a starting pulse to one of the transistors. This is effected by means of a breakdown element, or diac, connected on the one hand to the base of the transistors whose emitter is grounded and on the other hand between a capacitor and a resistor connected in series between the supply terminals and constituting a time base. Thus, once the voltage of the capacitor terminals is higher than the sum of the emitter to base voltage of the transistor and the breakdown voltage of the diac, the diac allows the starting pulse to pass through. However, as the charging capacitor of the LC series circuit is generally grounded, it is imperative that the series circuit has been charged before the transistor which short-circuits it allows current to pass due to the pulse from the diac. This requires an additional system which allows the series circuit to be precharged during the voltage increase of the time constant capacitor. This complicates the general circuit. Thus, a resistor 51 short-circuits the transistor 11 in specification EP No. 0171108; a special arm comprising a diode 17 and parallel connection of a capacitor 19 and resistor 21 controls a switch 14 allowing a capacitor 15 to charge through a capacitor 18 in specification WO No. 87/00719; and a weak charging current passes through a diode 31 and a resistor 32 in specification DE No. 3,412,944.

The problem of overlap in the conducting time of the bipolar transistors is caused by the fact that the time for passage from the saturated state to the block state is directly dependent on the collecter to emitter intensity. This phenomena implies, on one hand, thermal instability in the transistors and, on the other hand, a rapidly attained limit with regard to the number of lighting units with the base system. To overcome these disadvantages, it is necessary to use systems which are more complex for synchronizing the state of the power transistors so as to prevent simultaneous circulation of current in them which would lead, in the worse case, to a breakdown of those elements. This problem is solved in the European specification by means of a complex control circuit comprising time unit elements such as capacitors 33 and in specification WO No. 87/00719 by arranging several transistors in parallel, each one being controlled by its own secondary winding. The system described in specification DE No. 3,412,944 can apparently accommodate only one lighting unit.

A device has also been described in French Specification No. 2,487,140, which achieves certain objectives in a more elegant manner but which is used specifically for discharge lamps which do not include electrodes. This device generates a frequency of at least 0.5 mHz which is required for such discharge lamps. This device cannot be used for fluorescent tubes which operate optimally at a frequency between 100 and 200 kHz. Furthermore, the form of the AC voltage is detrimental to the service life of the coils. Moreover, this system does not allow several lighting units to be connected simultaneously. Finally, the yield of this device is only 87 lm/W, whereas the device proposed by the applicant allows a yield of 125 lm/W to be achieved.

SUMMARY OF THE INVENTION

A primary object of the present invention is to overcome the above-mentioned disadvantages by providing an electronic supply system for fluorescent tubes with electrodes, which system transmits a high frequency voltage to the terminals of the fluorescent tubes, allows instantaneous ignition of those tubes, and has a very good yield while allowing a reduction in the energy consumption by 45 to 50% relative to prior art assemblies.

To accomplish the above object, the system according to the present invention comprises a supply means which is connected to mains or to another AC source and which produces a DC voltage at its output terminals 1A and 1B, a time constant connected between the output terminals constituted by a series connection of a resistor and a capacitor, two power transistors connected in series between the output terminals and, connected to a common point between the transistors, a series connection comprising the primary winding of a transformer, the lighting unit or units and a capacitor.

The transformer has two secondary windings which control the transistors. The system also comprises a bilateral conducting element having a breakdown effect, such as a diac, connected, on one end between the resistor and the capacitor of the time constant and, at its other end, to the control arm of the transistor of which one of the other arms is connected to the output terminal 1B. The system of the present invention is characterized in that the transistors are of the metal-oxide-silicon (MOS) type and in that the capacitor in series with the lighting unit or units is connected to the output terminal 1A such that it only begins to charge itself as the transistor passes into the saturated state as a result of pulses from the diac.

BRIEF DESCRIPTION OF THE DRAWING

Other objects, advantages and novel features of the present invention from the following detailed description of the invention when considered in conjunction with the accompanying drawing in which the sole figure is a circuit diagram of a preferred embodiment of the present invention.

DETAILED DESCRIPTION OF THE INVENTION

As shown in the accompanying figure, the supply means for fluorescent tubes with electrodes according to the present invention comprises a supply means 1 which is connectable to mains or to another AC source and which produces a DC voltage at its output terminals 1A and 1B.

Supply means 1 comprises, in a known manner, and between its input terminals, a diode bridge 2 which rectifies the AC voltage from the network and, between the output terminals of said diode bridge, a capacitor 3, preferably of the electrochemical type which filters the rectified voltage. Two capacitors 4,4, which are connected in parallel between ground and the diode bridge, are connected across the input terminals of the supply means 1. These capacitors 4,4 allow high frequency interference generated by the system to be eliminated. A fuse 5 for protection against a possible short circuit is connected to one of the input terminals of the supply means. A resistor 6 which limits the input intensity in the supply means is connected to the other input terminal of the supply means.

A time base, time constant, or time constant developing element 7, comprised by the series connection of a resistor 8 and a capacitor 9, is connected across terminals 1A and 1B.

The lighting system for fluorescent tubes with electrodes according to the present invention comprises a capacitive element 10 connected to the positive terminal 1A of the supply means 1 and in series with at least one lighting unit 11, two control means 12 for controlling the charging state of the capacitive element 10 through the lighting unit or units, and a transformer of which the primary winding 13 is connected between the lighting unit or units 11 and the control groups and which primary winding 13 controls the control groups 12 depending upon the charge of the capacitive element 10. The capacitive element 10 is comprised by a capacitor of a known type.

The control circuit of each MOS transistor 14, which is connected between the source S and the gate G of each transistor 14, preferably comprises a secondary winding of the transformer, a resistor 16 connected in series with the secondary winding, and a zener diode 17 connected in parallel with the series connection between the secondary winding 15 and the resistor 16.

Zener diode 17, which is connected between the source S and the gate G and in parallel with the secondary winding 15/resistor 16 connection, protects the transistor 14 by preventing excessive bias voltage.

The secondary windings 15 of each of the control groups 12 issue from the transformer and are connected in antiphase on the same core as the primary winding 13. One group of controls 12, hereinafter designated the first group, is connected between the primary winding 13 of the transformer by the drain terminal D of one of the transistors 14 and the terminal 1B of the supply means by the source S of said transistor. The other group of controls 12, hereinafter designated the second group, is connected between the capacitive element 10 via the drain terminal D of one of the transistors 14 and the primary winding 13 of said transformer by the source S of the transistor.

In other words, two MOS type power transistors 14,14 are connected in series between the terminals 1A and 1B of the supply means. The transistor of the first control group 12 is connected to the terminal 1B by its source S. The drain of the transistor 14 from the first control group 12 is connected to the source of the transistor 14 from the second control group. The drain D of the transistor from the second control group is connected to terminal 1A of the supply means. A series arm which is connected to the center of this series arrangement, that is, to a common point between the transistors 14,14, comprises the primary winding 13 of the transformer, the lighting unit or units 11 and a charge capacitor 10, in that order, the latter being connected to the terminal 1A of the supply means.

The circuit thus comprises a first series arm connected between the terminals of the supply means and comprising the transistor 14 of the first group of controls, the primary winding 13 of the transformer, the lighting unit or units 11 and the charge capacitor 10. This series connection is short-circuited between the primary winding 13 of the transformer and the capacitor 10 by the transistor 14 of the second control group.

A bilateral conducting element having a breakdown effect, such a a diac 18, is connected between the gate G of the transistor 14 of the first control group 12 and the time constant 7. This diac 18 is connected on one end between the resistor 8 and the capacitor 9 of the time constant 7 and on the other end to the gate G of the transformer 14 of the first control group 12.

When the supply means 1 is made live, the capacitor 9 of the time constant 7 is charged through the resistor 8 until the voltage of the terminals of the capacitor 9 attains the threshold voltage of the diac 18 plus the weak voltage existing between the gate and the source of the transistor 14. Once this voltage is reached, the diac 18 allows passage of current and said voltage is present over the gate G of the transistor 14 of the first control group 12, allowing current to pass through this transistor. The conductivity of this transistor draws the charge of the capacitor 10 through the primary winding 13 of the transformer and the lighting unit or units.

The charge of capacitor 10 creates a voltage pulse to the transformer. This voltage pulse, transmitted by the primary winding 13 to the secondary windings 15,15, causes a change in bias in the gates G of the transistors 14,14 of the first and second groups 12,12. This change of bias blocks the transistor 14 of the first group 12 and allows passage of current to the transistor 14 of the second group 12.

The conducting state of the transistor of the second group causes discharge of the capacitor 10 through the primary winding 13 and the lighting unit or units 11. The voltage pulse due to the discharge of the capacitor is transmitted to the secondary windings 15,15, which again causes a change of bias in the gates G of the transistors 14,14. The system thus starts oscillating at a frequency F. The frequency F of the system according to the present invention is relatively low: between 100 and 200 kHz. This low frequency requires a relatively large capacitor 9 in the time constant 7.

The use of MOS transistors which switch at low voltage allows the number of turns needed in the transformer to be reduced. As a non-limiting example, the primary winding of the transformer is comprised by a single turn on a toroidal core having a diameter of 12 mm, and each secondary winding is constituted by two turns on the same core. This reduction in the number of turns reduces the electrical losses due to heating, the face shift induced between the voltage and the intensity in the series circuit and, consequently, the dimensions of the induction coils 19 may also be reduced. Furthermore, the external dimensions of the transformer are reduced to a cylinder having a diameter of 12 mm and a height of 5 mm.

It is advantageous that the primary winding of the transformer is constituted by at most five turns, and when each secondary winding of the transformer is constituted by at most ten turns.

According to a preferred embodiment shown in the accompanying figure, the system supplies two lighting units 11,11, but it goes without saying that this number is not limiting and that the system can receive a multitude of lighting units 11 or just one. Each lighting unit is connected in parallel between the primary winding 13 of the transformer and the capacitor 10. According to a preferred embodiment, each lighting unit 11 comprises a winding 19, a fluorescent tube 20 with two electrodes 21 and a capacitor 22 connected in series between the two electrodes or filaments 21.

The coil 19 of the lighting unit 11 allows a high voltage to be created and allows the tube 20 to be kept lit. The capacitor 22 connecting the filaments 21 of the same tube 20 recovers a portion of the oscillation and allows the filaments 21 to remain slightly hot. This effect allows ample space for passage of the electric current in the tube.

The alternating high-frequency signal present at the primary winding 13 of the transformer allows a large number of tubes to be operated. The charge present at the output of the system according to the present invention does not influence operation and frequency of the system. The tubes 20 are preferably connected two-by-two at the output of the system.

To allow instantaneous re-ignition, if necessary, of the lighting unit or units 11 or retriggering of the oscillation of the system during micropower cuts due to irregularities in the supply voltage, the system according to the present invention comprises a means for rapid discharge of the capacitor 9 of the time constant 7 when the transistor 14 of the first group 12 is conducting. According to a preferred embodiment of the present invention, this means comprises by a diode 23 having its anode connected to the time constant 7 and its cathode connected to the drain D of the transistor 14 of which the source is connected to the output terminal 1B, that is, to the common point of the two transistors 14; and by a resistor 24 connected between the terminal 1A of the supply means 1 and the anode of diode 23.

When the transistor 14 of the first group 12 is conducting, the diode 23 which is biased in the conducting direction causes rapid discharge of capacitor 9. This discharge is limited only by the low internal resistance of the transistor 14. To synchronize conduction by the diode 23 with conduction by the transistor 14 of the first group 12, resistor 24 biases said diode in the reverse direction (anode voltage lower than cathode voltage). The usefulness of this assembly is explained by the fact of the switching time of MOS transistors is shorter than the switching time of silicon diodes in general. The cathode of diode 23 is brought to a potential which is positive relative to its anode, causing blockage of the anode, so that the diode 23 conducts simultaneously with power transistor 14. When the transistor 14 is conducting, this blockage suddenly disappears and the diode 23 starts immediately conducting in phase with transistor 14. The effect of this particular arrangement does in fact accelerate conduction of the element 23. The presence of diode 23 to resistor 24 connection is therefore indispensable to operation of the system according to the present invention because of the low frequency created by this system.

On the other hand, because of the high voltages transmitted to the control circuit of the transistors 14,14 by the primary winding of the transformer 13 and to the rapidity of switching by the MOS transistors, the coil or coils 19 of the lighting unit or units receive an AC voltage having a rectangular signal, which signal causes useless heating of these coils 19, and, consequently, a drop in yield. To avoid this problem, a series connected capacitor 25 and resistor 26 are connected between the drain D of the transistor 14 of the first group 12 and the terminal 1A of the supply means 1. Thus, when the transistor 14 of the first group 12 is conducting, the capacitor 25 is charged through the resistor 26 and therefore introduces slight damping during the rising front of the signal as well as on the falling front during the discharge of the capacitor 10. The signal therefore has a more acceptable shape for the coil 19 of the lighting unit or units. Furthermore, this capacitor 25/resistor 26 arrangement allows the yield of the system to be increased by about 10% and allows the phenomena of dark spots caused by poor distribution of the ionized charges to be eliminated on fluorescent tubes 20. As an example, the yield of the system according to the present invention with two high-luminosity 50 W tubes 20 brings the yield to 125 lm/W.

By way of example only, mean values for electronic components that could be used in the system of the present to create a frequency F of about 125 kHz are as follows:

| Components | Values |
|---|---|
| Resistor 6 | 4.7 ohms |
| Resistor 8 | 300 k ohms |
| Resistor 26 | 18 ohms |
| Resistor 24 | 330 k ohms |
| Resistor 16 | 47 ohms |
| Capacitor 3 | 150 uf |
| Capacitor 25 | 5.6 nf |
| Capacitor 10 | 100 nf |
| Capacitor 22 | 3.3 nf |
| Capacitor 9 | 100 nf |
| Capacitor 4 | 10 nf |
| DC DIAC | 32 volts |

-continued

| Components | Values |
|---|---|
| Diode 23 | silicon dioxide |
| Diode 17 | 8.6 volt zener diode |
| Transistors 14,14 | MOS |
| Transformer | |
| Primary 13 | 1 turn on 12 mm diameter toroidal core |
| Secondary 15,15 | 2 turns on 12 mm diameter toroidal core |
| Coils 19 | 110 turns on 12 mm diameter square-sectioned pot |

The system according to the present invention can also supply gas-discharge lamps (such as mercury vapor lamps) under the same sparing conditions as fluorescent tubes with electrodes. As should be apparent to those skilled in the relevant art, from a review of the above, that the system of the present invention requires only a few electronic components. Accordingly, the risk of breakdowns of the system, in general, is reduced. This reliability can be further improved by selecting appropriate electronic components and by assembling the circuit on a completely automated machine. Moreover, this system can advantageously be produced in small dimensions, that is, two and/or less power transistors, supply capacitor, small transformer (12 mm×5 mm) and an electronic chip combining the remaining components, all within a volume of less than 40 mm×20 mm×20 mm.

Thus, the system according to the present invention allows instantaneous ignition of fluorescent tubes with electrodes, an increase in the service life of those fluorescent tubes, production of an excellent yield and consumption of very little electric current.

Obviously, numerous modifications and variations of the present invention are possible in light of the above teachings. It is therefore to be understood that within the scope of the appended claims, the invention may be practiced otherwise than as specifically described.

I claim:

1. An electronic supply system for fluorescent tubes with electrodes, said system connectable across an AC source, said system comprising:

(a) a supply means for providing DC voltage, said supply means having input terminals adapted to be connected across said AC source and first and second output terminals across which said supply means provides a DC voltage;

(b) an element having a time constant, said element connected across said first and second output terminals, said element comprising a resistor connected in series with a capacitor, said resistor and said capacitor having a common electrical point therebetween;

(c) two MOS power transistors connected in series between said first and second output terminals, said two MOS power transistors having a common electrical point therebetween;

(d) at least one lighting unit connected in circuit between said common electrical point between said two power transistors and said first output terminal;

(e) a transformer having a primary winding and first and second secondary windings, the primary winding of said transformer connected in circuit between said at least one lighting unit and said common electrical point between said two power transistors;

(f) means for controlling one of said two MOS power transistors, said means including the first secondary winding of said transformer;

(g) means for controlling the other of said two MOS power transistors, said means including the second secondary winding of said transistor said means connected in circuit to said output terminal;

(h) a bilateral conducting element having a breakdown effect connected in circuit between said common point between the resistor and capacitor of the element having a time constant and said means for controlling the other of said two MOS power transistors, said bilateral conducting element having a breakdown effect being operable to provide a pulse;

(i) a capacitor connected in circuit between said at least one lighting unit and said output terminal, said capacitor only beginning to be charged when one of said two MOS power transistors is saturated as a result of the pulse provided by the bilateral conducting element having a breakdown effect; and (j) said means for controlling one of said two MOS power transistors comprises the first secondary winding of said transformer, a first resistor connected in series with the first secondary winding, and a first zener diode connected in parallel with the series connection of said first secondary winding of said transformer and said first resistor and; further, wherein said means for controlling the other of said two MOS power transistors comprises the second secondary winding of said transistor, a second resistor connected in series with the second secondary winding, and a second zener diode connected in parallel with the series connection of said second secondary winding of said transformer and said second resistor.

2. A system as claimed in claim 1 wherein the primary winding of said transformer has at most five turns, the first secondary winding of said transformer has at most ten turns, and the second secondary winding of said transformer has at most ten turns.

3. A system as claimed in claim 1 wherein said system oscillates and further comprising:

(a) means for causing instantaneous restarting of system oscillation, said means comprising:

(i) a diode having its anode connected to the common point between the resistor and capacitor of the time constant and its cathode connected in circuit to the drain of the other of said two MOS power transistors; and (ii) a resistor connected in circuit between said cathode of the diode and said first output terminal.

4. A system as claimed in claim 1 further comprising means for supplying a voltage having a nonrectangular form to said at least one lighting unit, said means comprising a resistor and a capacitor connected in series, this series connection of a resistor and a capacitor connected in circuit between said first output terminal and the drain of the other of said two MOS power transistors.

5. An electronic supply system for fluorescent tubes with electrodes, said system connectable across an AC source, said system comprising:

(a) a supply means for providing DC voltage, said supply means having input terminals adapted to be connected across said AC source and first and second output terminals across which said supply means provides a DC voltage;

(b) an element having a time constant, said element connected across said first and second output terminals, said element comprising a resistor connected in series with a capacitor, said resistor and said capacitor having a common electrical point therebetween;

(c) two MOS power transistor connected in series between said first and second output terminals, said two MOS power transistors having a common electrical point therebetween;

(d) at least one lighting unit connected in circuit between said common electrical point between said two power transistors and said first output terminal;

(e) a transformer having a primary winding and first and second secondary windings, the primary winding of said transformer connected in circuit between said at least one lighting unit and said common electrical point between said two power transistors;

(f) means for controlling one of said two MOS power transistors, said means including the first secondary winding of said transformer;

(g) means for controlling the other of said two MOS power transistors, said means including the second secondary winding of said transistor said means connected in circuit to said second output terminal;

(h) a bilateral conducting element having a breakdown effect connected in circuit between said common point between the resistor and capacitor of the element having a time constant and said means for controlling the other of said two MOS power transistors, said bilateral conducting element having a breakdown effect being operable to provide a pulse;

(i) a capacitor connected in circuit between said at least one lighting unit and said first output terminal, said capacitor only beginning to be charged when one of said two MOS power transistors is saturated as a result of the pulse provided by the bilateral conducting element having a breakdown effect; and (j) means for supplying a voltage having a nonrectangular form to said at least one lighting unit, said means comprising a resistor and a capacitor connected in series, this series connection of a resistor and a capacitor connected in circuit between said first output terminal and the drain of the other of said two MOS power transistors.

* * * * *